417-154 SR
1/28/86 X2 4,566,861

United States Patent [19]
Landfors

[11] Patent Number: 4,566,861
[45] Date of Patent: Jan. 28, 1986

[54] METHOD OF AND APPARATUS FOR OPERATING A DIFFUSION PUMP

[75] Inventor: Arthur A. Landfors, Brookline, Mass.

[73] Assignee: Varian Associates, Inc., Palo Alto, Calif.

[21] Appl. No.: 607,867

[22] Filed: May 7, 1984

[51] Int. Cl.[4] ..... F04F 9/00
[52] U.S. Cl. ..... 417/54; 236/78 D; 417/154
[58] Field of Search ..... 417/152, 153, 154, 53, 417/54; 165/11 R; 236/78 D, 78 B

[56] References Cited

U.S. PATENT DOCUMENTS 3,282,330 11/1966 Landfors ..... 165/11 R
4,108,576 8/1978 Landfors ..... 417/153
4,210,823 7/1980 Kabat et al. ..... 236/78 D X

*Primary Examiner*—Edward K. Look
*Attorney, Agent, or Firm*—Stanley Z. Cole; Leon F. Herbert

[57] ABSTRACT

A diffusion pump is operated by controlling the rate at which vapor is evaporated from a pool in response to an indication of the effectiveness of a fluid in cooling a condensation surface for the vapor as derived by sensors for the temperatures of the pool and along a temperature gradient from the pool to a cooling coil for the condensation surface. When the sensors indicate that the vapor is not effectively cooling the surface, liquid is vaporized from the pool, but at a slower rate than when the fluid is effective in cooling the surface. To increase the life of a brass strap on the temperature gradient, opposite ends of the strap are connected to a cooling coil for the condensation surface and a stainless steel block connected to a well in which is located an electric heater for vaporizing the oil from the pool.

11 Claims, 2 Drawing Figures

Fig. 1
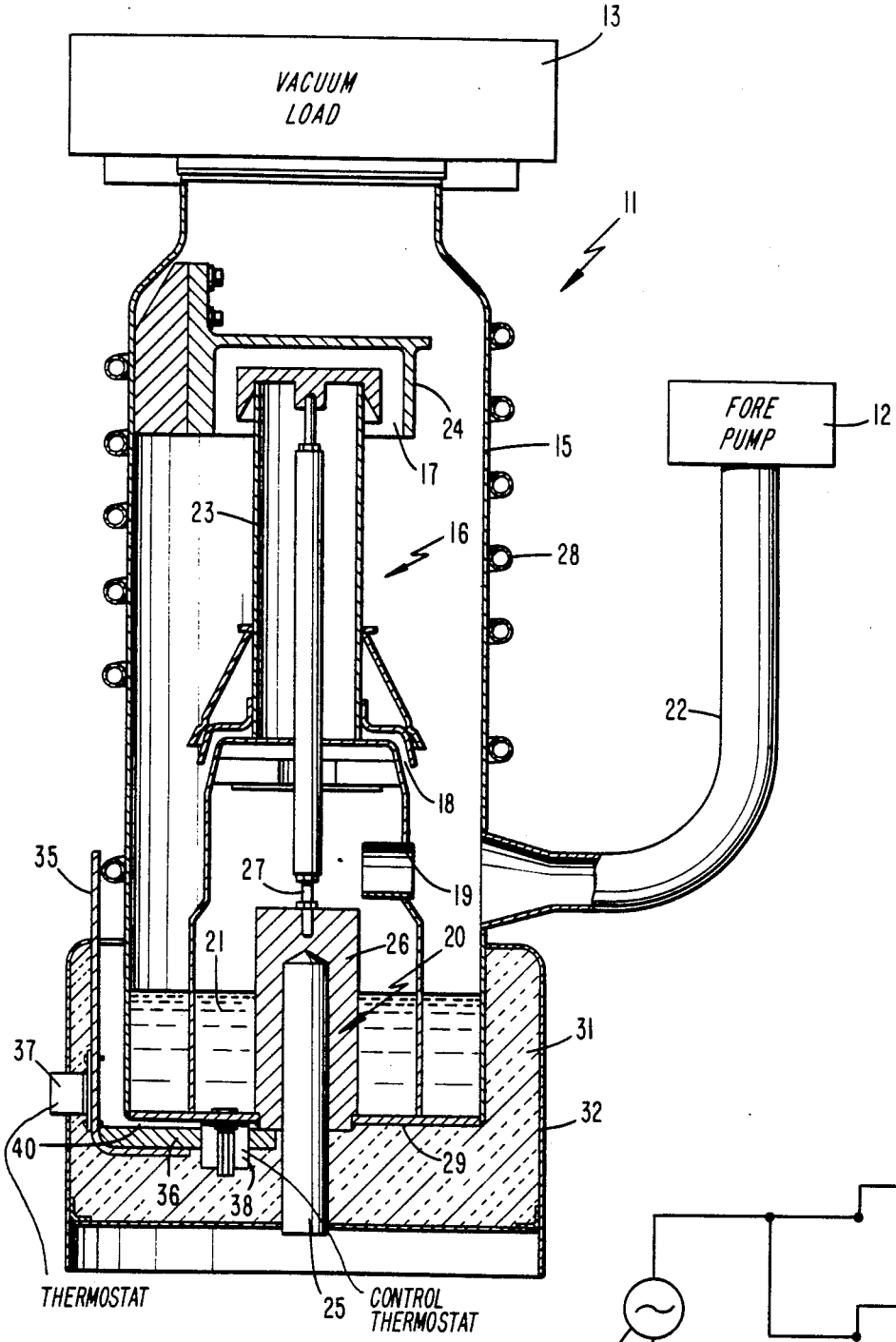
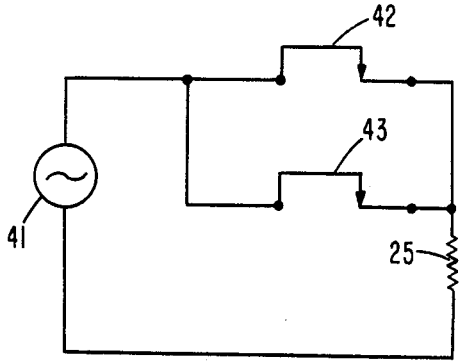
Fig. 2

METHOD OF AND APPARATUS FOR OPERATING A DIFFUSION PUMP

TECHNICAL FIELD

The present invention relates generally to a method of and apparatus for operating a diffusion pump and more particularly to such a method and apparatus wherein the rate at which vapor is evaporated from a pool is controlled in response to indications of the effectiveness of a fluid cooling a condensation surface for the vapor as derived from a first sensor for the pool temperature and a second temperature sensor along a thermal gradient between the condensation surface and pool. In accordance with a further aspect, the invention is related to a diffusion pump having a brass temperature gradient establishing element that is connected to a stainless steel plate which abuts against a high temperature well for an electric heater for the pool or a high temperature boiler plate at the pool bottom.

BACKGROUND ART

Certain vacuum systems include a fore pump and a diffusion pump. The fore pump evacuates a vacuum load chamber to a pressure on the order of $10^{-2}$ Torr. When such a pressure is reached, the diffusion pump is activated, to reduce the pressure in the vacuum chamber to a much lower pressure, such as $10^{-6}$ Torr.

Diffusion pumps are typically characterized by a pool of liquid that is vaporized by an electric heater. The vapor is directed by one or plural nozzles against condensation surfaces. The vapor is condensed on the condensation surface and returns, by gravity, to the pool. Typically, the condensation surface is cooled by a cooling fluid, typically water, in a cooling coil contacting the condensation surface.

If there is a failure in a cooling system including the cooling coil, typically manifested by a failure of the coil to contain coolant fluid, the condensation surface becomes excessively hot, whereby vapor incident on the surface does not condense. Thereby, the diffusion pump does not operate properly and the diffusion pump overheats. To prevent such overheating it has been generally the prior art practice to halt operation of the diffusion pump by turning off the heater for vaporizing the liquid in the pool.

Halting operation of the diffusion pump causes the vacuum load to increase in pressure to the vacuum which can be attained by the fore pump. When the problem associated with the cooling system has been rectified, it is necessary to restart the diffusion pump and to reduce the vacuum load pressure several orders of magnitude. This is a time consuming process which can have a deleterious effect on the operation of the equipment in the vacuum chamber.

It has been suggested that this time consuming operation can be obviated by controlling the rate at which the vapor is evaporated in response to an indication of the effectiveness of the fluid in cooling the condensation surface. The vapor is evaporated so that when the fluid is completely ineffective in cooling the surface, liquid is evaporated from the pool, but at a slower rate than when the fluid is effective in cooling the surface. The indication of the effectiveness of the fluid in cooling the condensation surface has been obtained with a single thermostat located along a temperature gradient between the pool and cooling coil. The thermostat has temperature hysteresis characteristics, whereby normally closed contacts of the thermostat open at a temperature associated with an excessively high pool temperature and reclose at a lower temperature. Opening and closing of the contacts respectively cause power to be removed from and applied to an electric heating coil for liquid, i.e. oil, in the pool. Thereby the pool oil is cyclicly heated and cooled with a net lower amount of energy being supplied to it than during normal operation. It has been found, however, that a single relatively inexpensive thermostat is not reliable because different thermostats have considerably different characteristics.

The temperature gradient is frequently established by a metal strap between the cooling coil and stainless steel well surrounding an electric heater coil in the center of the pool; this general configuration is disclosed in my U.S. Pat. No. 3,282,330. In my aforementioned patent the strap or bar is disclosed as being copper. For years, however, the strap of the commercial product made in accordance with the teachings of U.S. Pat. No. 3,282,330 has been made of brass because of the tendency for copper to oxidize and because copper has a very high thermal conductivity. The copper oxidation tendency should be avoided because it causes variations in the temperature response of the temperature sensor on the strap. The very high copper thermal conductivity should be avoided because of the high heat loss and resulting low thermal efficiency associated with it. A problem with the use of brass, however, is that after several years the strap breaks at the intersection thereof with the very high temperature well (normally about 500°-550° F.).

It is accordingly an object of the invention to provide a new and improved diffusion pump.

It is an additional object of the present invention to maintain a diffusion pump pumping capacity at a reduced level when there is a complete loss of pump coolant.

It is an additional object of the present invention to provide a new and improved method of and apparatus for enabling a diffusion pump to be restored to full operation rapidly in the event of a failure of a cooling system for a condensation surface thereof.

Another object of the invention is to provide a new and improved method of and apparatus for accurately determining the effectiveness of a fluid in cooling a diffusion pump condensation surface wherein inexpensive thermostats can be used.

A further object of the invention is to provide a new and improved diffusion pump configured to have a brass temperature gradient establishing element having a longer life than such elements on prior art pumps.

DISCLOSURE OF INVENTION

In accordance with one aspect of the present invention, the effectiveness of a cooling fluid on a condensation surface of a diffusion pump having a pool of liquid that is heated to a vapor is determined by sensing the temperature of the pool, establishing a temperature gradient between the pool and surface, and sensing the temperature at two locations along the gradient. The temperatures are sensed by relatively inexpensive thermostats which have been found to provide a much more reliable measure of the effectiveness of the cooling fluid on the condensation surface than a single thermostat on the thermal gradient between the pool and cooling oil.

The rate of evaporation is controlled by controlling the amount of power supplied to an electric heater coil for the liquid in response to both of the sensed temperatures. The pump operates in (a) a normal manner when cooling fluid is supplied to a cooling coil on the surface and (b) an abnormal manner when no cooling fluid is supplied to the cooling coil. Power is supplied to the heater at high and low levels when both of the sensed temperatures indicate the pump is operating in the normal and abnormal manners, respectively. The high and low power levels are both sufficient to vaporize the liquid in the pool. The low power level is such that the heat of condensation resulting from the vapor impinging on the condensation surface is removed by natural convection to an environment in which the surface is located instead of by the cooling fluid. Thus, in effect, the evaporation rate is controlled so that when the pump is operating in the normal manner there is a faster evaporation rate than when the pump is operating in the abnormal manner.

The condensation surface is cooled by a cooling coil in contact with the surface. The coil has an interior adapted to be supplied with a cooling fluid, typically water. A means for sensing the temperature includes a metal mass of high thermal conductivity between the cooling coil and pool so that a thermal gradient exists through the mass. The temperature is sensed along the thermal gradient, as well as in the pool. First and second temperature responsive switches are respectively positioned to sense the temperatures along the gradient and at the pool. The first temperature responsive switch is preferably between the pool and cooling coil although it may be on the cooling coil or condensation surface if there is no possibility of excessively high oil pool temperatures; such excessively high oil pool temperatures are likely if the oil does not boil because of a vacuum failure in the pump or a failure to provide oil in the pool.

The first and second switches are normally activated to first and second states and connected to the heater and a heater power source. A first predetermined amount of energy is supplied to the heater to vaporize liquid in the pool at a first rate in response to the cooling fluid being supplied to the coil, i.e. with the cooling system operating in a normal manner. The first and second switches are respectively activated to second and first states and connected to the heater and source so a second predetermined amount of energy is supplied to the heater to vaporize liquid in the pool at a second rate in response to no fluid being supplied to the coil, i.e. with the cooling system operating in an abnormal manner. The first predetermined amount of energy is greater than the second predetermined amount of energy, while the first predetermined rate is greater than the second predetermined rate.

To prolong the life of diffusion pump temperature gradient establishing brass elements and obviate the long term breaking tendency thereof, a stainless steel block is fastened to a heated metal mass that vaporizes the pool oil; the heater metal mass is the well or the boiler plate if the diffusion pump is of a type that does not include a well. The brass element extends between the coil and a location on the stainless steel block remote from the well or boiler plate so all parts of the brass element, including the part contacting the stainless steel block, are at temperatures substantially lower than the well or boiler plate temperature. This obviates the long term tendency of the brass element to break because it no longer intersects the very high temperature well or boiler plate.

In the preferred embodiment, the second sensor is mounted on the boiler plate and has a sensing surface for the pool temperature in contact with the boiler plate. Opposite ends of the stainless steel block have opposite faces respectively abutting against the well and brass element. The remainder of the face contacting the well is spaced from all pool confining and heating structures, i.e., the boiler plate. It is to be understood that the stainless steel plate can be employed in pumps having a single thermostat mounted on the brass element at an intermediate point having a temperature between the coil and pool temperatures. Of course, in such an instance the stainless steel plate does not carry a temperature sensor.

The above and still further objects, features and advantages of the present invention will become apparent upon consideration of the following detailed description of one specific embodiment thereof, especially when taken in conjunction with the accompanying drawings.

BRIEF DESCRIPTION OF THE DRAWINGS

FIG. 1 is a sectional, partly schematic, view of a diffusion pump in accordance with the invention; and FIG. 2 is a circuit diagram including thermostatic switches for controlling the heater of FIG. 1.

BEST MODE FOR CARRYING OUT THE INVENTION

Reference is now made to FIG. 1 of the drawing wherein diffusion pump 11 is illustrated as being connected in fluid flow relation between fore pump 12 and vacuum load 13. Fore pump 12 is activated initially, while diffusion pump 11 remains inoperative, to reduce the pressure in vacuum load 13 to a pressure on the order of $10^{-2}$ Torr. Then, diffusion pump 11 is activated to reduce the pressure in vacuum load 13 to a considerably lower pressure, such as $10^{-6}$ Torr.

Diffusion pump 11 comprises a generally cylindrical metal body 15, assembly 16 including diffusion pump nozzles 17 and 18, ejector nozzle 19, heater assembly 20 for evaporating liquid in pool 21 and fore line 22. Assembly 16 includes vertically extending stack 23 for providing a flow path for vapor from pool 21 to nozzles 17 and 18. Vapor from pool 21 flows directly to ejector nozzle 19, thence to fore line 22. Nozzle 17 is formed integrally with cold cap 24. Heater assembly 20 includes a resistance, electric heater 25, of the cartridge type, which abuts against and is concentric with cylindrical metal heater well 26, preferably machined from stainless steel. Assembly 16 is secured to cylindrical heater well 26 by stem 27. Helical cooling coil 28, through which a coolant fluid normally flows, is wound on the exterior surface of cylinder 15. Typically, water or some other cooling agent is supplied to the interior of coil 28 from a suitable source (not shown) to form a cooling system for body 15 so the body can function as a condensation surface for vapor from nozzles 17 and 18. Disc shaped boiler plate 29, in contact with cylindrical heater well 26, transfers heat from the cylindrical heater well to fluid at the bottom of pool 21. Insulation mass 31, surrounding the boiler is enclosed by cylindrical casing 32.

In operation, well 26 is typically at a temperature of about 500° F.-550° F. to cause vapor to be evaporated from pool 21. The vapor from pool 21 flows upwardly through stack 23, thence outwardly and downwardly through nozzles 17 and 18 to trap molecules from vacuum load 13. The vapor is incident on the interior, cooled surface of cylindrical body 15. The cooled surface of body 15 condenses the vapor, which then flows by gravity back to pool 21. Vapor from pool 21 also flows to ejector nozzle 19 which ejects it into fore line 22. Vapor in fore line 22 is sucked by fore pump 12. This is the normal and conventional structure and operation of a diffusion pump.

A problem with the prior art, conventional diffusion pump, as described, is that in certain instances there is a malfunction of the cooling system and cooling fluid does not flow through cooling coil 28. In such an event, cylinder 15 becomes excessively hot and can not condense vapor from nozzles 17 and 18. Thereby, diffusion pump 11 is rendered inoperative and it is necessary to completely shut down the diffusion pump. Such shut down of diffusion pump 11 has been achieved previously by monitoring the effectiveness of the coolant in coil 28 on cooling body 15.

To these ends, the temperature at a point between cooling coil 28 and boiler plate 29 has been monitored with a high thermal conductivity path between the coil and plate, which path is formed by brass strap 35. Opposite ends of strap 35 are connected to cooling coil 28 and boiler plate 29, in a manner known to those skilled in the art and shown in my U.S. Pat. No. 3,282,330 but not shown on the drawing accompanying the present specification wherein the improved construction of one aspect of the present invention is illustrated. Thermostat 37 is mounted on strap 35 at an intermediate location between cooling coil 28 and plate 36.

Thermostat 37 includes contacts series connected between a power source and heater coil 25. In response to the temperature monitored by thermostat 37 on strap 35 exceeding a predetermined value, associated with a failure of body 15 to be cooled by cooling coil 28 or an excessive temperature of pool 21, normally closed contacts of thermostat 37 become open circuited, so that heating coil 25 is no longer connected to the AC power source. Thereby, power is removed from heater assembly 20 and in the typical prior art configuration vaporization from pool 21 discontinues. Cylindrical body 15 is then cooled to the ambient air temperature because vapor is no longer being vaporized from pool 21 and is not incident on the body. The thermal lag associated with reheating pool 21 to restart the vaporization process is sufficiently great to prevent thermostat 37 from activating diffusion pump 11 into an operative state prior to complete shut down of the pump. Thereby, diffusion pump 11 completely shuts down and the presence of vacuum load 13 quickly increases to that of fore pump 12 until the reason for the failure of the cooling system including coil 28 has been determined and the problem has been rectified. When the problem has been rectified, considerable start up time is necessary until pump 11 is again able to evacuate load 13 to the desired pressure.

This problem is obviated by operating heater 25 at reduced power when cylindrical body 15 less effectively condenses vapor from pool 21 because of a failure of the cooling system including coil 28. In the past, heater 25 has been operated at reduced power by placing and selecting thermostat 37 so contacts of the thermostat remain closed until the temperature sensed by the thermostat reaches a predetermined value associated with proper operation of the pump cooling system. Power is supplied to the heater coil through the closed contacts and is decoupled from the heater coil when the pump cooling system fails, as detected by thermostat 37. When the temperature sensed by thermostat 37 drops to a predetermined value a few degrees less than the temperature at which the thermostat contacts open in response to the cut off of power to the heater coil, the thermostat contacts again close. Closure of the thermostat contacts restores power to the heater coil. In normal operation thermostat 37 senses a temperature of about 450° F.

While this prior art approach functions in theory and is satisfactory in certain instances, it has been found to be generally unreliable for most available relatively inexpensive thermostats. Because there are fairly large tolerances of contact opening and closing temperatures of relatively inexpensive thermostats the temperature at which the contacts of such thermostats open and close is subject to wide variation, as is the differential between the contact opening and closing temperatures. The problem is compounded because the temperatures of strap 35 at opposite ends of the thermal gradient, between coil 28 and pool 21, are both subject to wide variations. The temperature at coil 28 is normally in the 60°-90° F. range but may increase to about 300° F. in the event of a failure of water flow through coil 28. The temperature of pool 21 is normally about 500° F. but is susceptible of rising to 700°-1000° F.; the pool temperature rises to these temperatures if no oil is in the pool or if the interior of pump 11 is not in a vacuum because the pump is improperly connected to fore pump 12.

In accordance with the present inveention, much more accurate and reliable control of the power supplied to heater coil 25 is provided by adding control thermostat 38 to the pump and mounting it to sense temperature changes in pool 21 quickly. Central thermostat 38 has a much narrower operating differential than thermostat 37. In response to the temperature of pool 21 decreasing by virtue of contact 37 disconnecting heater coil 25 from the power supply for it, but prior to evaporation from pool 21 being discontinued, thermostat 38 reconnects the power source to heater coil 25.

Thermostat 38 has a temperature sensing face abutting against the exterior lower wall of boiler plate 29, at a location spaced from well 26. To enable thermostat 38 to be very sensitive to the temperature changes of pool 21, boiler plate 29 is relatively thin, approximately 3/16 inch thick, and the bottom face thereof remote from pool 21 is generally spaced from any materials having high thermal conductivity, except where the temperature sensitive face of thermostat 38 abuts against the boiler plate. In particular, the bottom face of boiler plate 29 abuts against insulation 31 or air pocket 40. Under normal operating conditions, i.e. when a vacuum is in pump 11 and pool 21 contains oil, thermostat 38 senses a temperature of about 450° F.

To separate brass strap 35 from the high temperatures of well 26 and increase the life of the strap to in excess of ten years while maintaining a linear thermal gradient between pool 21 and cooling coil 28, stainless steel block 36 extends radially between and is connected to the bottom end of strap 35 remote from coil 28, and the lower face of well 26. The inner end of the upper face of block 36 is welded to the lower face of well 26, while the outer end of the lower face of block 36 is silver soldered to strap 35 along portions of an upwardly facing surface of the strap and an inwardly facing vertical surface of the strap end. The remainder of the upper surface of block 36 defines the bottom of pocket 40, i.e., is spaced from boiler plate 29. This construction minimizes the direct thermal effects of well 26 on thermostat 38 so the thermostat accurately monitors the temperature of pool 21. During normal operation, with coil 28 at room temperature and pool 21 at 450° F., the intersection of strap 35 and block 36 is about 300° F., to extend the life of the strap to in excess of ten years.

An electric circuit for connecting AC power source 41 to heater coil 25 in response to temperatures sensed by thermostats 37 and 38 is illustrated in Figure 2. Thermostats 37 and 38 respectively control operation of contacts 42 and 43, connected between AC power source 41 and heater coil 25. In typical situations, contacts 42 are closed at room temperature, open at 275° F., and reclose at 235° F., while contacts 43 are closed at room temperature, open at 450° F., and reclose at 420° F. During normal operation of diffusion pump 11 thermostat 37 senses a temperature of 250° F. at the intermediate location on strap 35 where thermostat 37 is located as a result of the upper end of strap 35, in contact with coil 28, being at a temperature in the range of 60°-90° F., while pool 21 and plate 29 are at a temperature of 450° F. Thereby thermostat 38 senses a temperature of 450° F. Under the stated conditions, contacts 42 and 43 are respectively closed and open so that the current flows from source 41 through contact 42 to coil 25.

In response to a failure of the cooling system including cooling coil 28, the temperature of the upper end of strap 35 in contact with cooling coil 28 increases considerably above 90° F. In response to the increased temperature at the upper end of strap 35, the temperature of thermostat 37 increases to 275° F. to activate contact 42, to open circuit the path between power source 41 and heater coil 25. Because of the thermal inertia of coil 28, cylindrical body 15 and strap 35, approximately five minutes elapse between the time water stops flowing in coil 28 and the time when the temperature sensed by thermostat 37 reaches a value of 275° F. If heater coil 25 were continuously supplied with power, i.e., if thermostat 37 were not included, all of the liquid in pool 21 would be vaporized and serious deleterious effects would occur to diffusion pump 11. Such deleterious effects are avoided by cutting off the flow of current to heater coil 25 by open circuiting contact 42 when thermostat 37 senses a temperature of 275° F.

When contact 42 is open circuited, fluid in pool 21 continues to be vaporized. The heat of evaporation to the fluid in pool 21 is supplied by heat stored in cylindrical heater wall 26, boiler plate 29 and the liquid in pool 21. As liquid from pool 21 is evaporated with heater coil 25 de-energized, the remaining fluid in the pool rapidly cools and there is a rapid drop in temperature of the fluid. In response to the temperature of boiler plate 29 dropping from 450° F., the normal operating temperature therefore, to 420° F., a process which takes about four minutes due to the thermal inertia of pool 21, heater assembly 20 and boiler plate 29, thermostat 38 activates contact 43 to close the contact and re-establish a current path from source 41 to heater coil 25. During the entire interval while power source 41 is decoupled from heater coil 25, liquid is continuously evaporated from pool 21 and diffusion pump 11 remains in operation. In response to contacts 43 closing, additional heat is supplied to pool 21 by heater coil 25, to reinitiate the evaporation process of liquid in pool 21. In response to the liquid in pool 21 increasing in temperature by 5° F. from 420° F. to 425° F., thermostat 38 activates contacts 43 to reopen them. Cooling of the liquid in pool 21 again occurs until the temperature sensed by thermostat 38 drops to 420° F., at which time the thermostat again closes contacts 43. In this manner, thermostat 38 controls contact 43 so vaporization of liquid in pool 21 continues.

Thermostat 38 and contact 43 now cause heater coil 25 to operate with a duty cycle of about 0.5, so coil 25 supplies an average power level to pool 21 that is considerably lower than the power coil 25 normally supplies to the pool while coolant flows in cooling coil 28. The reduced average power level is sufficient, however, to sustain continuous evaporation of liquid from pool 21 and maintain continuous operation of diffusion pump 11 at a lower rate. At this reduced average power level, the heat of condensation caused by vapor from nozzles 17 and 18 being incident on body 15 is removed by natural convection of the ambient room temperature environment around pump body 15.

Pump 11 continues to function, although at reduced capacity relative to normal operation. Thereby, the pressure in vacuum load 13 increases to a certain extent, but to a pressure which is considerably less than the pressure which would occur in the vacuum load if diffusion pump 11 were completely inoperative. Diffusion pump 11 continues to operate at the reduced capacity until plant personnel have had an opportunity to correct the cooling system connected to coolant coil 28. After the cooling system has been repaired, the pressure in vacuum load 13 is quickly reduced in response to thermostat 37 sensing a lower temperature of 250° F., as subsists during normal operating conditions.

The inclusion of thermostat 38 for monitoring the temperature of oil in pool 21 has the further advantage of preventing deleterious high temperature effects which could occur if oil in pool 21 does not boil. Failure of the oil in pool 21 to boil can occur if: (1) there is an improper vacuum in pump 11 (i.e. 2 Torr or higher) which suppresses boiling of the oil with a resulting rapid increase in temperature, and (2) oil is not placed in pool 21 after a maintenance procedure. The resulting high temperature of pool 21 is sensed directly by thermostat 38 and is coupled to thermostat 37 via strap 35. Thereby, the temperatures sensed by thermostats 37 and 38 are sufficient to open circuit contacts 42 and 43 and decouple power from heater 25.

While there has been described and illustrated one specific embodiment of the invention, it will be clear that variations in the details of the embodiment specifically illustrated and described may be made without departing from the true spirit and scope of the invention as defined in the appended claims.

I claim:

1. A method of operating a diffusion pump having a pool of liquid that is heated to a vapor and has a condensation surface for the vapor, the surface being supplied with a coolant fluid during normal operation of the pump, comprising the steps of determining the effectiveness of the fluid by: sensing the temperature of the pool, establishing a temperature gradient from the pool to the surface, and sensing the temperature at an intermediate location on the gradient; and controlling the rate of which the vapor is evaporated in response to an indication of the effectiveness of the fluid in cooling the condensation surface so that when the fluid is determined as being completely ineffective in cooling the surface liquid is vaporized from the pool but at a slower rate than when the fluid is effective in cooling the surface, the rate of evaporation being controlled by controlling the amount of power supplied to a heater for the liquid in response to both of the sensed temperatures.

2. The method of claim 1 wherein the pump is controlled to operate in a normal manner when cooling fluid is supplied to a coil on the surface and an abnormal manner when no cooling fluid is supplied to the coil, supplying power at high and low levels to the heater when both of the sensed temperatures indicate the pump is respectively operating in the normal and abnormal manners, the high and low power levels both being sufficient to vaporize the liquid in the pool, the low power level being such that the heat of condensation on the condensation surface is removed by natural convection to an environment in which the surface is located.

3. The method of claim 1 wherein the rate is controlled so that when the pump is operating in a normal manner when the surface is cooled by a cooling fluid there is a faster evaporation rate than when the pump is operating in an abnormal manner when the surface is cooled by convection between the surface and environment in which the surface is located and not by the cooling fluid.

4. A diffusion pump comprising a pool of liquid, means for vaporizing liquid in the pool, a condensation surface on which the vaporized liquid is incident, means for cooling the condensation surface with a cooling fluid, means for sensing the effectiveness of the fluid in cooling the surface effectively to determine whether or not the cooling fluid is being supplied to the means for cooling, the means for sensing including means for sensing temperatures at two locations normally having disparate temperatures along a temperature gradient extending from the condensation surface to the pool, and means responsive to the sensed temperatures for controlling the vaporizing means to control the rate at which liquid is evaporated from the pool so that when the fluid is completely ineffective in cooling the surface liquid is vaporized from the pool but at a slower rate than when the fluid is effective in cooling the surface.

5. The pump of claim 4 wherein the means for cooling includes a coil in contact with the surface, the coil having an interior adapted to be supplied with a cooling fluid, the means for sensing including: thermally conductive mass connected between the coil and pool in such a manner that a thermal gradient exists through the mass, and means for sensing temperatures along the thermal gradient and at the pool.

6. The pump of claim 5 wherein the vaporizing means includes an electric heater, means for connecting an electric supply to the heater during normal operation of the pump, the temperature sensing means and the connecting means including first and second temperature responsive switches respectively positioned to sense the temperature along the gradient remote from the pool and at the pool, the first and second switches being normally activated to first and second states and connected to the source and heater so a first predetermined amount of energy is supplied to the heater to vaporize liquid in the pool at first rate in response to the fluid being supplied to the coil, the first and second switches being respectively activated to second and first states and connected to the source and heater so a second predetermined amount of energy is supplied to the heater to vaporize liquid in the pool at a second rate in response to no fluid being supplied to the coil, the first predetermined amount of energy being greater than the second predetermined amount of energy, the first predetermined rate being greater than the second predetermined rate, the first switch responding to changes in temperature along the gradient from the pool to the coil such that the first switch changes from the first state to the second state at a time so that if it were connected in series with the heater and supply it would be incapable of supplying sufficient energy to the heater to vaporize liquid in the pool prior to vaporization of the liquid being discontinued.

7. A diffusion pump comprising a pool of liquid, means for vaporizing liquid in the pool, a condensation surface on which the vaporized liquid is incident, a cooling coil in contact with the condensation surface, means for establishing a thermal gradient that normally subsists between the coil and pool, a first temperature sensor positioned to respond to a temperature along the gradient at a location normally having a temperature substantially less than at the pool, the first sensor deriving a first response indicative of the temperature at said location, and a second temperature sensor thermally connected to the pool for deriving a second response indicative of the pool temperature, and control means responsive to the first and second responses, the control means responding to the first and second responses to indicate the pump operating in a normal manner wherein cooling fluid is supplied to the coil and an abnormal manner wherein the cooling fluid is not supplied to the coil, the control means supplying power at high and low levels to the heater when the first and second responses respectively indicate the pump is operating in the normal and abnormal manners, the high and low power levels both being sufficient to vaporize the liquid in the pool, the low power level being such that the heat of condensation on the condensation surface is removed by natural convection to an environment in which the surface is located.

8. A diffusion pump comprising a pool of liquid, an electric heater for vaporizing liquid in the pool, a condensation surface on which the vaporized liquid is incident, a cooling coil in contact with the condensation surface, a thermal gradient normally subsisting between the pool and coil, means for monitoring the temperature at an intermediate point along the thermal gradient, said means for monitoring including: a brass element and a temperature sensor mounted at the intermediate point; a metal mass for applying heat to the pool, the metal mass being heated by the heater to a sufficient temperature so as to have a tendency to cause long term breaking of the brass element if the element were in contact with it, a stainless steel block fastened to the metal mass, the brass element extending between the coil and a location on the stainless steel block remote from the well so all parts of the brass element are at temperatures substantially lower than the temperature of the metal mass to obviate the long term breaking tendency.

9. The pump of claim 8 further including an additional temperature sensor, a boiler plate having a first face defining the bottom of the pool, the additional temperature sensor having a temperature sensitive face on a second face of the boiler plate opposite to the first face of the boiler plate, the stainless block being spaced from the second boiler plate face.

10. The pump of claim 9 wherein the metal mass includes a metal well surrounding the heater, the stainless steel block being secured to the metal well.

11. The pump of claim 8 wherein the metal mass includes a metal well surrounding the heater, the stainless steel block being secured to the metal well, a boiler plate having a first face defining the bottom of the pool, the stainless block being spaced from a second boiler plate face opposite to the first face of the boiler plate.

* * * * *